United States Patent [19]

Borgstrom et al.

[11] Patent Number: 4,946,393

[45] Date of Patent: Aug. 7, 1990

[54] SEPARABLE CONNECTOR ACCESS PORT AND FITTINGS

[75] Inventors: Alan D. Borgstrom; David R. Stevens, both of Hackettstown, N.J.

[73] Assignee: Amerace Corporation, Parsippany, N.J.

[21] Appl. No.: 389,572

[22] Filed: Aug. 4, 1989

[51] Int. Cl.[5] ..... H01R 4/58

[52] U.S. Cl. ..... 439/88; 439/190; 439/921; 439/912; 324/122

[58] Field of Search ..... 174/11 BH, 73.1; 324/122, 133; 439/88, 89, 181, 186, 190, 198, 519, 521, 523, 604, 912, 921, 480

[56] References Cited

U.S. PATENT DOCUMENTS

| | | | |
|---|---|---|---|
| 3,390,331 | 6/1968 | Brown et al. | 324/122 |
| 3,568,136 | 3/1971 | Wells | 439/912 |
| 3,649,952 | 3/1972 | Harmon | 439/190 X |
| 3,736,505 | 5/1973 | Sankey | 324/122 X |
| 3,883,208 | 5/1975 | Sankey et al. | 439/921 X |

*Primary Examiner*—Neil Abrams

*Assistant Examiner*—Khiem Nguyen

*Attorney, Agent, or Firm*—David Teschner

[57] ABSTRACT

The invention is the provision of an access to the interior of a high voltage separable connector component by providing a projection of insulating elastomeric material integral with the insulating material of the body of the component and in engagement with the conductive elastomeric material shield of such component. A bore extends through the projection from a free, remote face to the component interior. The bore can be straight walled and if desired can be fitted at its remote end with appropriate fittings to permit external devices or internals to interact with the elements within said component body. A cap of conductive elastomeric material is fabricated to fit over the projection providing an interference fit therewith to seal out moisture and dirt and assure the continuity of the component shield layer, the free end of said cap engaging the conductive shield layer of said component and an insulating probe arranged to fill the bore and dilate same to seal said bore and assure the dielectric strength of said projection.

15 Claims, 4 Drawing Sheets

SEPARABLE CONNECTOR ACCESS PORT AND FITTINGS

BACKGROUND OF THE INVENTION

1. Field of the Invention:

The invention relates to an apparatus to gain access to the interior of a high-voltage separable connector component while same is in operation to permit certain external devices and materials to interact with elements within and more particularly for the injection of fluids or gases into the conductor strand interstices, for venting fluids or gases within the component or directly testing the inner conductive elements or for the reading of remote sensing devices and data collection.

2. Description of the Prior Art:

In order not to interfere with the integrity of the shield or insulation about the components of high voltage separable connectors, only limited testing of the operation of the system or external interaction with internal elements was permitted. In U.S. Pat. No. 3,390,331, issued June 25, 1968 to R. R. Brown et al. and assigned to the assignee of the instant invention, a metallic plate was molded into the insulation of the component housing. Current flowing in the main conductor within the component induced a charge on such metallic plate which could be detected via a threaded rod exposed when a cap was removed from the housing attached to the component housing. No access to the main conductor or any part within the component housing was possible.

U.S. Pat. No. 2,857,557, issued Oct. 21, 1958 shows a closed system in which fluid insulating materials such as oil or compressed air may be added at coupling joints between cables and bus bars insulated with resin materials.

U.S. Pat. No. 3,624,594, issued Nov. 30, 1971 shows a flash test member 33 by which the electrical connector assembly can be placed under pressure to test for leaks with a soapy water solution.

U.S. Pat. No. 3,649,952, issued Mar. 14, 1972 shows connector components in a sealed system which can be separated by the application of pressurized gas from outside of the connector.

In each of the above cases, access to the interior of the component housing is limited or for a limited purpose only.

SUMMARY OF THE INVENTION

The present invention overcomes the difficulties noted above with respect to the prior art by providing a direct access to the interior of a high voltage separable connector component to permit the interaction of an external device or material with one or more elements within the component. Such interaction can be the injection of fluids or gases into the conductor strand interstices, the venting of fluids or gases within the component or the direct testing of the inner conductive elements or the reading of remote sensing systems.

Such access is facilitated by the provision of a projection of insulating elastomeric material integral with the insulating material of the body of the component and in engagement with the conductive elastomeric material shield of such component. A bore extends through the projection, having a generally frusto-conical shape, from the smaller diameter free remote face to the component interior adjacent the larger diameter projection base in which parts of the shield material are embedded.

The bore can be straightwalled and, if desired, can be fitted at its remote end with appropriate fittings to permit external devices or materials to interact with the elements within said component body.

A cap of conductive elastomeric material, having a complementary frusto-conical shape is dimensioned to fit over the outer surface of the projection and in an interference fit therewith to seal out moisture and dirt and assure the continuity of the component shield layer due to the engagement of the free ends of the cap with the shield material at the base of the projection. An insulating probe carried by said cap to fill said bore and of a diameter greater than that of the bore, dilates the insulating elastomeric material of the projection which defines the bore walls to insure intimate contact with the probe to seal such bore and assure the dielectric strength of said projection. An annular recess is provided adjacent the free face of the projection to receive a detent rib formed on the interior of the cap to lock the cap and projection together to prevent unwanted separation. An apertured portion remote from the cap free end provides means by which the cap may be removed or installed upon the projection by use of a hot stick. It is an object of this invention to provide a direct access to the interior of a high voltage separable connector component.

It is an object of this invention to provide a direct access to the interior of a high voltage separable connector component without compromising the integrity of the insulation or shield of such separable connector component.

It is an object of this invention to provide a direct access to the interior of a high voltage separable connector component by means of a projection integral with the body of such component and having a bore therethrough from an exterior surface of such projection to the interior of said component.

It is another object of this invention to provide a direct access to the interior of a high-voltage separable connector component by means of a projection integral with the body of such component and having a bore therethrough from an exterior surface of such projection to the interior of said component and a cap to fit over said projection to assure the integrity of the component insulation and shield.

It is yet another object of this invention to provide direct access to the interior of a high voltage separable connector component having an insulating material body covered by a conductive shield by means of a projection of insulating material integral with the insulating body of said connector component and having a bore therethrough from an exterior surface of said projection to the interior of said connector component and a cap of conductive material arranged to fit over said projection and contact the conductive shield to complete the shield of the component and the projection and an insulated probe to completely fill said bore and assure the dielectric strength of said insulation of said component and said projection.

Other objects and features of the invention will be pointed out in the following description and claims and illustrated in the accompanying drawings which disclose, by way of example, the principle of the invention and the best mode which has been contemplated for carrying it out.

BRIEF DESCRIPTION OF THE DRAWING

In the drawings in which similar elements are given similar reference characters.

DESCRIPTION OF THE PREFERRED EMBODIMENT

Figure 1:
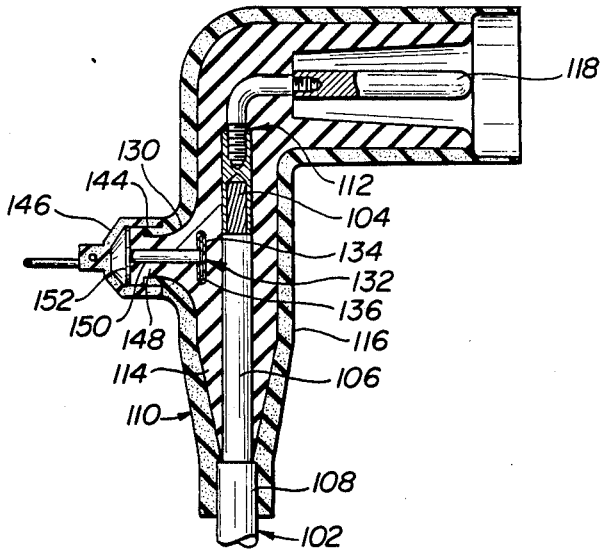
FIG-1 PRIOR ART
FIG. 1 is a side elevational view, in section, of a high voltage separable connector component—namely an elbow having a voltage detection point and is FIG. 3 of U.S. Pat. No. 3,390,331, issued June 25, 1968 to R. R. Brown et al., entitled "Device for Detecting the Presence of Voltage in Connectors of High Voltage Systems," and assigned to the assignee of the instant invention.

Turning now to FIG. 1, there is shown a cable 102 having a conductor 104 surrounded in turn by an insulating layer 106 and an outer shield 108 of conductive elastomeric. High voltage separable connector component or elbow 110 comprises a conductor assembly 112, a surrounding insulator 114 of insulating elastomeric material, an outer conductive shield 116 of conductive elastomeric material and a conductive male probe 118. Connector 110 is provided with an opening or break 130 in the conductive shield 116 and an electrode assembly 132 is located within the insulator 114 in such close proximity with internal conductor 104 to enable the voltage therein to place an electric charge upon the electrode assembly 132 which includes a metallic plate 134 surrounded by conductive elastomeric 136. Connector 110 is provided with an integrally molded neck 144 shaped to receive a cap 146, both the neck 130 and the cap 146 being of conductive elastomeric material so as to maintain the electrical conductivity of the outer shield as long as the cap 146 is in place upon the neck 130. A core 148 of insulating elastomeric is molded integral with the insulator 114 and projects through the neck 144 to establish the desired break in the shield when the cap 146 is removed from the neck. The electrode assembly 132 is provided with an electrically conductive stem 150 having an integral disk-like head 152 and being molded into the connector 110 as a part of the electrode assembly 132. When the cap 146 is removed, any electrical charge on the electrode assembly 132 may be detected by placing a voltage detection device against head 152 and the presence of voltage at the internal conductor 104 can be determined.

No other access is possible within connector 110 and it is not possible to directly contact conductor 104 and determine if a voltage is present. If stem 150 were to corrode and its contact between plate 134 and head 152 break, the presence of a voltage in conductor 104 could not be detected.

Figure 3:
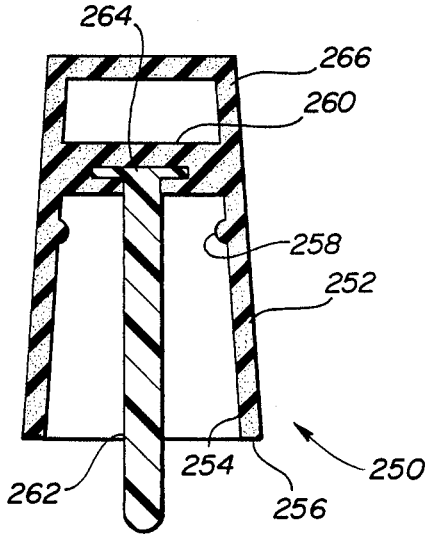
FIG. 3 is a side elevational view, in section, of the cap portion of the access constructed in accordance with the concepts of the invention.
Figure 2:
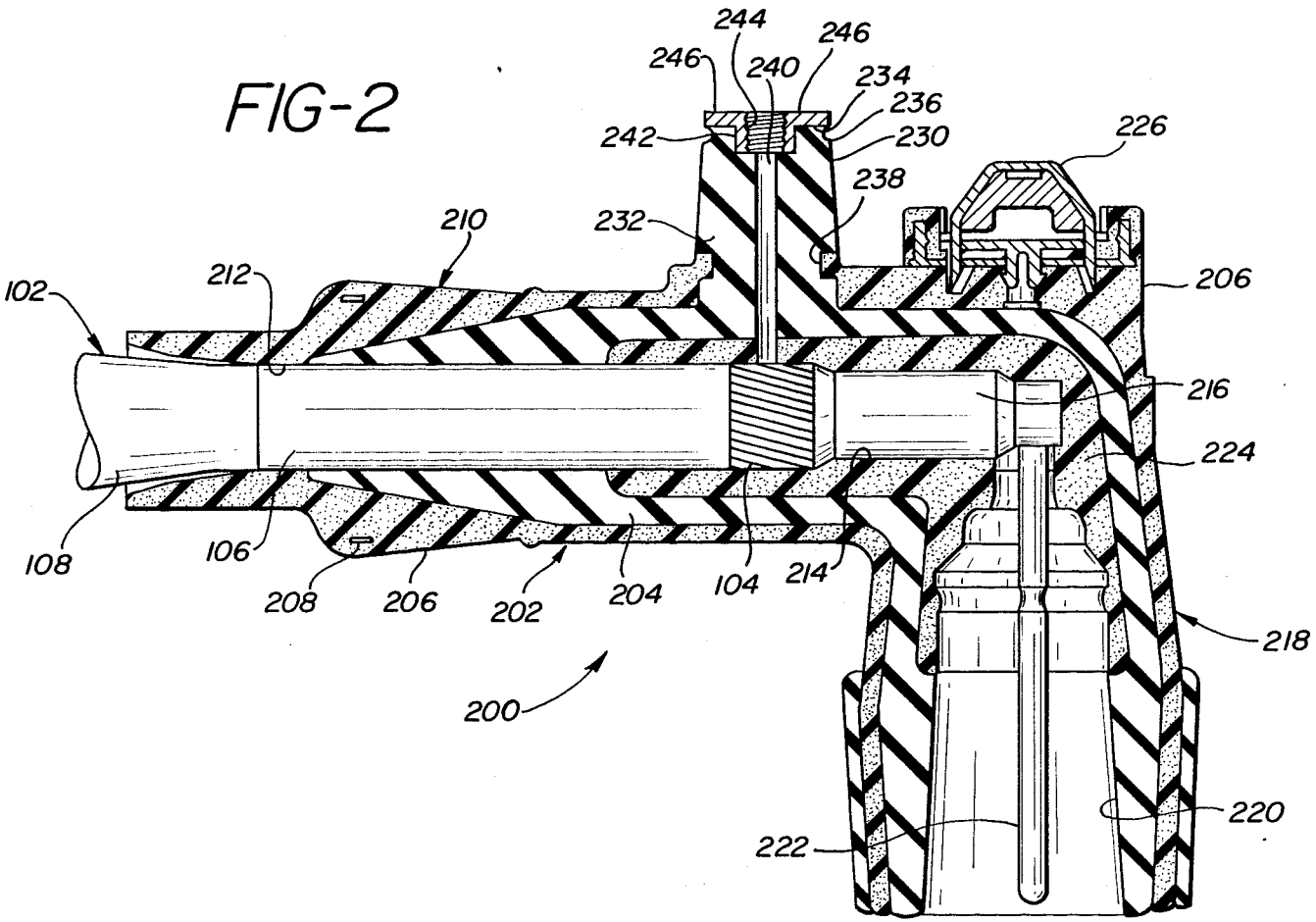
FIG. 2 is a side elevational view, in section, of a high voltage separable connector component—namely an elbow having an access constructed in accordance with the concepts of the invention.
Figure 4:
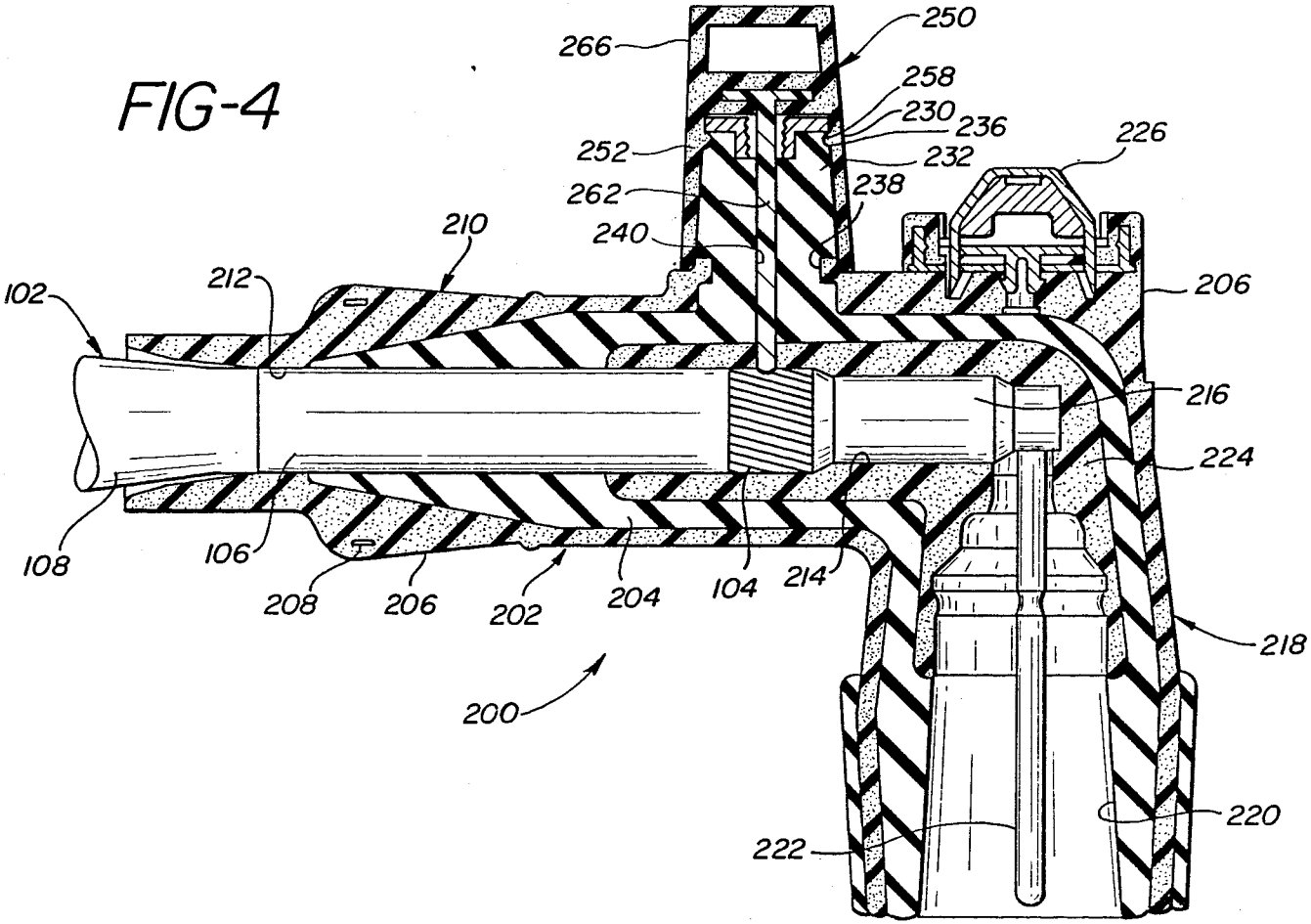
FIG. 4 is a side elevation, in section, of the cap of FIG. 3 installed upon the access of the high voltage separable connector component of FIG. 2.

Referring to FIGS. 2, 3 and 4, the access according to the instant invention is shown. A high voltage separable connector component or elbow 200 is shown. Elbow 200 has a body portion 202 molded of an insulating elastomeric 204. Molded to 204 and with void-free interfaces is an external shield 206 of conductive elastomeric. Ports 208 are provided in shield 206 to attach suitable ground conductors. Leg 210 has a central bore 212 of a diameter sufficient to accept the insulation 106 and shield 108 of cable 102 when properly dilated. A crimp connector 216 crimped to the bared conductor 104 is positioned within bore 214 also in leg 210. Second leg 218 has a central receptacle 220 to receive a bushing insert (not shown) as is well known in the art. A male probe 222 extends from the crimp connector 216 and through the receptacle 220.

An additional layer of conductive elastomeric 224 is deposited on selective portions of the interior of bores 212, 214 and receptacle 220 to shield the assembled conductor 104, the crimp connector 216 and the probe 222. A pulling eye 226 is bonded to the shield 206 and is arranged to be engaged by a hot stick (not shown) to couple and uncouple elbow 200 to a bushing insert (not shown). An arrangement as discussed herein is shown in U.S. Pat. No. 4,175,815 issued Nov. 27, 1979, and assigned to the assignee of the instant invention.

The shield 206 is interrupted on leg 210 and the insulating elastomeric 204 of body portion 202 is extended upwardly, away from bores 212 and 214 to form projection 230 having a generally frusto-conical cross-section with its wide diameter base 232 adjacent shield 206 of body portion 202 and its smaller diameter free face 234 remote therefrom. Adjacent free face 234 is an annular recess 236 to receive the detent rib of the cap to be described below. A recess 238 is formed in base 232 and the shield layer 206 is permitted to fill such recess to permit the cap to contact the shield layer 206 and complete the shield about projection 230 as will be described below.

A central bore 240 extends through projection 230 from free face 234, through the conductive elastomeric shield 224 into central bore 212 of leg 210. Bore 240 is enlarged as at 242 adjacent free face 234 to receive an internally threaded collar 244 attached to an apertured insulating plastic plate 246 which is bonded to free face 234. As will be described below, various devices can be coupled to the plate 246—collar 244 to inject or remove various fluids from the interior of said elbow 200.

The presence of projection 230 represents a break in the shield layer 206 and a break in the insulation body 204. To fully restore the integrity of the body insulation 204 and complete the shield layer 206, a cap 250 as is best seen in FIG. 3 is employed. Cap 250 has a hollow skirt portion 252 in a frusto-conical shape to closely conform to the outer surface of projection 230. On the interior surface 254 of skirt portion 252, remote from free end 256, is an annular detent rib 258 configured and positioned to engage annular recess 236 to hold in assembly cap 250 and projection 230. The interior surface 254 of skirt 252 is dimensioned to provide an interference fit with the outer surface of projection 230 to exclude air and seal against moisture. Also, since the entire cap 250 is fabricated from a conductive elastomeric material and its free end 256 contact the shield 206, as well as the interior surface 254 contacts the portions of shield 206 in recess 238, total integrity of the shield 206 is restored.

Above skirt portion 252 is a bridge 260 and above that a pulling eye 266 by which the cap 250 may be installed upon projection 230 or removed therefrom by means of a hot stick (not shown) as is well known in the art. Bridge 260 and pulling eye 266 are also made of conductive elastomeric material.

An insulating rod 262 having a head portion 264 is mounted in bridge 260 with the head portion 264 generally embedded in bridge 260. The insulating rod which may be of a suitable plastic, such as nylon, is dimensioned so that when inserted into bore 240 of projection 230, it dilates the insulating material 232 which defines the bore 240 so that it firmly grips rod 262 in an interference fit. In that manner, the bore 240 is completely filled and the dielectric strength of projection 230 is restored as is seen in FIG. 4.

Figure 5:
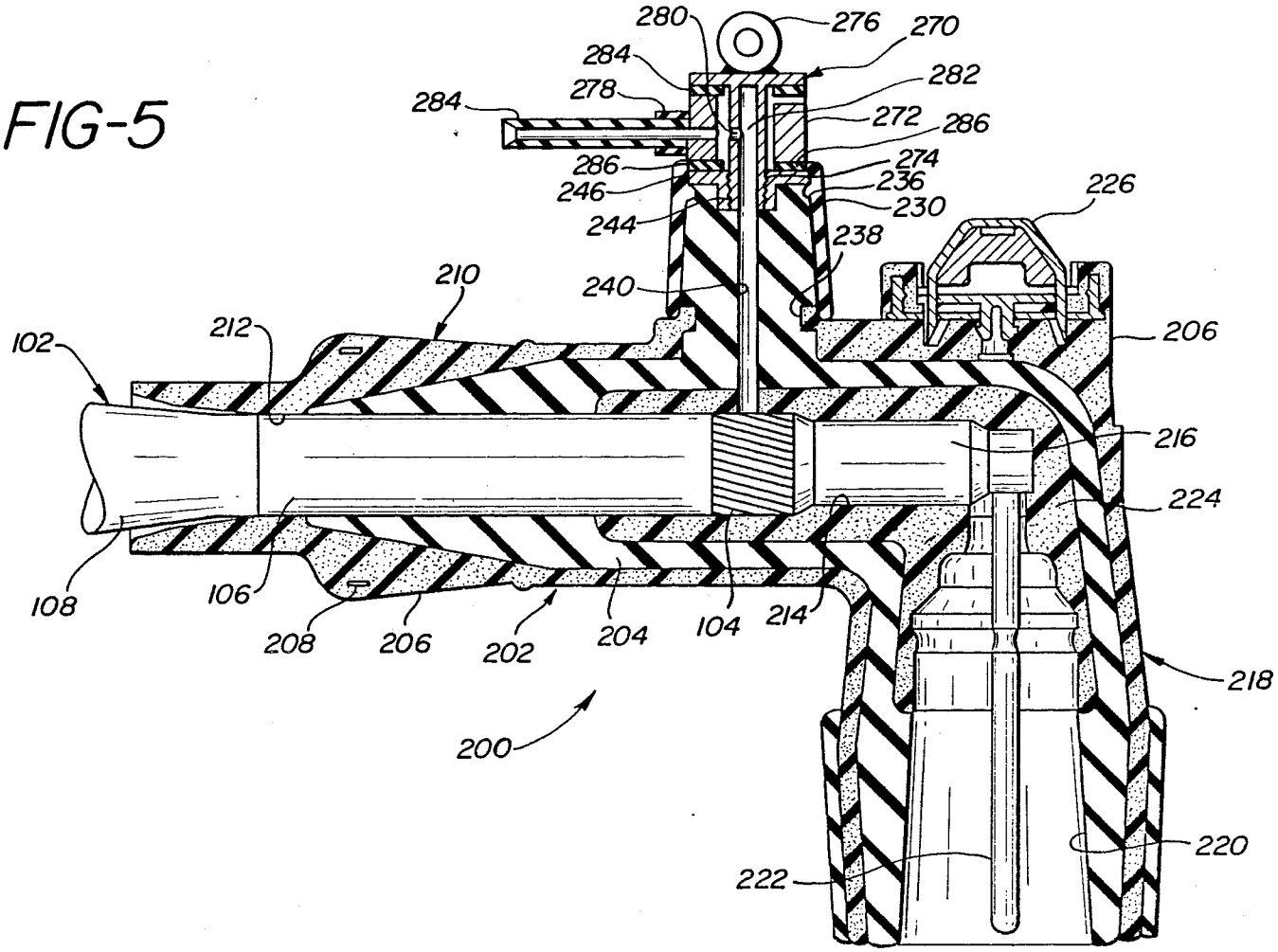
FIG. 5 is a side elevational view, in section, of the high voltage separable connector component of FIG. 2 with a swivel type hydraulic fitting for injecting fluid into the cable installed to the access.

The presence of a voltage on conductor 104 is directly determinable by inserting a probe down bore 240 once cap 250 has been removed. By use of a thermometer inserted into bore 240, the operating temperature of the conductors 104 and the elbow 200 can be checked. Any other data available or the readout of remote sensors could also be accomplished by the insertion of suitable detectors into bore 240. To insert or remove fluids or gases from the elbow 200 itself or the cable 102 in the elbow 200, a fitting such as the swivel type hydraulic fitting 270 shown in FIG. 5 could be employed. Main body 272 has an externally-threaded extension 274 at a first end to mate with the threads of internally-threaded collar 244 of projection 230 and an eye ring 276 at the other to permit fitting 270 to be installed on projection 230 or removed therefrom by means of a hot-stick (not shown). A side port 278 permits a suitable hose 284 to be coupled to fitting 270. Internal ducts 280 and 282 permit the fluids or gases to pass through hose 284 into and out of bore 240. Seals 284 and 286 seal the fitting 270 itself and the joint with projection 230 at plate 246. By coupling a vacuum pump (not shown) to hose 284, moisture, gases, such as hydrogen, collected in cable 102 or elbow 200 could be withdrawn. Also liquid, moisture and contaminates from the cable could be driven out by a clean, dry replacement medium introduced into a similar fitting attached to a separable connector at the other end of cable 102.

If materials are to be introduced into cable 102, a suitable pump (not shown) is attached to hose 284. These can be liquid or gel type materials to import new properties to the cable 106. For example, a liquid intended to gel, once in position, can be used to seal the strands of the conductor 104 against the migration of moisture through the cable 106. Cooling fluids for forced cooling of the cable 106 could be used for increased ampacity or where the cable is pressurized to introduce the fluid and to apply the required pressure. Also, the gases within cable 102 could be removed for analytical or other purposes. It should be understood that all of these tests and operations can be conducted while the cable 106 is fully operational and conducting current.

While there have been shown and described and pointed out the fundamental novel features of the invention as applied to the preferred embodiment, it will be understood that various omissions and substitutions and changes of the form and details of the device illustrated and in its operation may be made by those skilled in the art without departing from the spirit of the invention.

The embodiments of the invention in which an exclusive property or privilege is claimed are defined as follows:

We claim:

1. An access to the interior of a high voltage separable connector component to permit interaction with elements within said component comprising:

a projection extending radially, outwardly away from the body portion of said high voltage separable connector component;

said projection having an outer surface and an outer free face spaced apart from the body portion of said connector component, and an axially located bore extending from said outer free face to the interior of said connector component;

and a removable cap member positionable upon the outer surface of said projection and over said outer free face to seal said bores, said cap member having a probe made of insulating material dimensioned to enter and fill said bore when said cap member is positioned upon the outer surface of said projection and over the outer free face thereof.

2. An access as defined in claim 1, wherein said probe is dimensioned so as to dilate the bore and establish an interference fit between said probe and the walls defining said bore.

3. An access as defined in claim 1, further comprising a circumferential recess in said outer surface and a complementary detent upon the inner surface of said cap to selectively lock said cap to said projection.

4. An access as defined in claim 1, further comprising an insulating plastic plate bonded to the outer free face of said projection, an internally threaded collar extending from said plate into said bore and an aperture through said plate to permit passage through said plate and said collar into said bore.

5. An access as defined in claim 1, wherein said projection is fabricated from insulating elastomeric material.

6. An access as defined in claim 1, wherein said projection is fabricated from insulating elastomeric material integral with the body portion of said connector component.

7. An access as defined in claim 1, wherein said cap has a central portion into which said probe is attached; an upper apertured grip by which said cap can be selectively installed or removed from said projection and a lower skirt portion whose inner surface engages said outer surface of said projection.

8. An access as defined in claim 7, wherein all of said cap except said probe is fabricated from conductive elastomeric material.

9. An access as defined in claim 8, wherein the free end of the lower skirt portion of said cap engages the conductive elastomeric material of said connector component to provide a complete conductive shield about said projection.

10. An access as defined in claim 1, wherein said projection is frusto-conical in cross-section.

11. An access to the interior of a high voltage separable connector component having a body portion fabricated of an insulating elastomeric material and having bonded to the outer surface thereof a layer of conductive elastomeric material forming a shield thereabout to permit interaction with elements within said component comprising:

a projection of insulating elastomeric material integral with insulating elastomeric material of said component, said projection extending radially, outwardly away from a base at said body portion and having an outer surface and an outer free face spaced apart from said body portion and an axially located bore extending from said outer free face to the interior of said body portion, said layer of conductive elastomeric material extending into the base of said projection; and a removable cap member fabricated from a conductive elastomeric material having a hollow skirt portion positionable upon said projection with the free edge of said skirt portion engaging said layer of conductive elastomeric material at said projection base to provide a complete conductive shield about said projections, said cap member having a probe made of insulating material and dimensioned so as to dilate the bore and establish an interference fit between said probe and the insulating elastomeric material defining said bore to restore the full dielectric strength of said insulating elastomeric material.

12. An access as defined in claim 11, wherein said projection has a circumferential recess in said outer surface and a complementary detent upon the inner surface of said skirt portion of said cap to selectively lock said cap to said projection, the inner surface of said skirt being in an interference fit with said outer surface of said projection to exclude air, seal against moisture and restore the integrity of the shield about said connector component.

13. An access as defined in claim 11, wherein said cap further comprises an apertured portion to facilitate installation and removal of said cap with respect to said projection.

14. An access as defined in claim 11, further comprising an insulating, plastic plate bonded to the outer free face of said projection, an internally threaded collar extending from said plate into said bore and an aperture through said plate to permit passage through said plate and said collar into said bore.

15. An access as defined in claim 11, wherein said projection is frusto-conical in cross-section.

* * * * *